US010518286B2

(12) United States Patent
Adams et al.

(10) Patent No.: US 10,518,286 B2
(45) Date of Patent: Dec. 31, 2019

(54) NOZZLE ASSEMBLIES FOR COOLANT SYSTEMS, METHODS, AND APPARATUSES

(71) Applicant: Airgas USA, LLC, Radnor, PA (US)

(72) Inventors: William Adams, Houston, TX (US); Joanne Burrows, Houston, TX (US); Charles Cory, Wilmington, DE (US)

(73) Assignee: AIRGAS USA, LLC, Radnor, PA (US)

( * ) Notice: Subject to any disclaimer, the term of this patent is extended or adjusted under 35 U.S.C. 154(b) by 311 days.

(21) Appl. No.: 15/445,122

(22) Filed: Feb. 28, 2017

(65) Prior Publication Data

US 2018/0243762 A1 Aug. 30, 2018

(51) Int. Cl.

| | |
|---|---|
| ***B05B 1/14*** | (2006.01) |
| ***B05B 15/62*** | (2018.01) |
| ***B05B 7/08*** | (2006.01) |
| ***B05B 9/00*** | (2006.01) |
| *B01F 15/06* | (2006.01) |

(52) U.S. Cl.

CPC ..... *B05B 15/62* (2018.02); *B05B 7/0892* (2013.01); *B05B 9/005* (2013.01); *B01F 15/063* (2013.01)

(58) Field of Classification Search

CPC ..... B05B 15/65; B05B 7/0408; B01F 15/063; B67D 1/0857

USPC ..... 141/9, 82, 100, 104

See application file for complete search history.

(56) References Cited

U.S. PATENT DOCUMENTS

| | | | | |
|---|---|---|---|---|
| 5,366,156 | A | 11/1994 | Bauer et al. | |
| 5,603,567 | A | 2/1997 | Peacock | |
| 6,045,300 | A | 4/2000 | Antoun | |
| 6,363,729 | B1 | 4/2002 | Brahmbhatt et al. | |
| 7,950,841 | B2 | 5/2011 | Klein | |
| 8,287,786 | B2 | 10/2012 | Thomas | |
| 8,387,402 | B2 | 3/2013 | Littrup et al. | |
| 8,978,437 | B2 | 3/2015 | Malas et al. | |
| 2003/0136461 | A1* | 7/2003 | Lohr | B01F 5/0403 141/9 |
| 2007/0171764 | A1* | 7/2007 | Klein | B01F 15/063 366/4 |

(Continued)

FOREIGN PATENT DOCUMENTS

DE 4302026 C1 5/1994

OTHER PUBLICATIONS

"Learning to predict driver route and destination intent," Blakeborough Desuperheating Equipment & Systems, pp. 1-12, Weir Power & Industrial, Access Date: Dec. 18, 2015.

*Primary Examiner* — Brian M King
(74) *Attorney, Agent, or Firm* — RatnerPrestia

(57) ABSTRACT

Aspects of the invention include a nozzle assembly having a housing configured for attachment to the wall of the vessel. The housing has a proximal end portion and a distal end portion spaced from the proximal end portion along a length of the housing. The housing defines a passageway extending from the proximal end portion to the distal end portion, which is delineated by an inner surface of the housing. The nozzle assembly further includes a nozzle that has a base portion adapted for coupling to the housing, a shaft portion that extends from the base portion, and a tip portion coupled to the shaft portion of the nozzle. The tip portion defines a plurality of orifices. The nozzle also has an outer surface extending along a length of the nozzle that is spaced from the inner surface of the housing to create a gap when the nozzle is coupled to the housing.

8 Claims, 15 Drawing Sheets

(56) References Cited

U.S. PATENT DOCUMENTS

2011/0297274 A1* 12/2011 Hilliard, Jr. ..... A45D 40/24
141/9

* cited by examiner

NOZZLE ASSEMBLIES FOR COOLANT SYSTEMS, METHODS, AND APPARATUSES

FIELD OF THE INVENTION

The present invention is directed to coolant systems and methods and, more particularly, to systems and methods employing nozzle assemblies for dispersing a coolant.

BACKGROUND OF THE INVENTION

Rotary mixers are often utilized to mix food compositions including poultry, meat, fish, etc., in a vessel prior to forming the food composition into shapes, such as nuggets or patties. In order to obtain adequate consistency and viscosity such that the food composition remains in the formed shape, it is advantageous to cool the food composition. Coolants are typically used to cool the food composition. However, there remains a need for improved nozzle assemblies for dispersing coolant, such as nozzle assemblies offering the advantages of the present invention, which will become apparent from the description of the invention provided herein and the appended drawings.

SUMMARY OF THE INVENTION

Aspects of the present invention include coolant systems, methods, and apparatuses.

In accordance with one aspect, the invention provides a nozzle assembly for dispersing a coolant. The nozzle assembly includes a housing configured for attachment to the wall of the vessel. The housing has a proximal end portion affixable to the wall of the vessel over the aperture and a distal end portion spaced from the proximal end portion along a length of the housing. The housing defines a passageway extending along the length of the housing from the proximal end portion to the distal end portion. The passageway is delineated by an inner surface of the housing. The nozzle assembly further includes a nozzle that has a base portion that is adapted for coupling to the distal end portion of the housing, a shaft portion that extends from the base portion, and a tip portion that is coupled to the shaft portion of the nozzle. The tip portion of the nozzle defines a plurality of orifices. The nozzle also has an outer surface extending along a length of the nozzle that is spaced from the inner surface of the housing to create a gap when the nozzle is coupled to the housing.

In accordance with another aspect, the invention provides a method for switching from delivery of a first coolant to delivery of a second coolant. The method includes attaching a first nozzle for dispersing a first coolant to a housing affixed to a vessel. The first nozzle has a tip portion that defines a first plurality of orifices for dispersing a first coolant in two or more directions, a base portion that is adapted for coupling to the housing, and a shaft portion that extends between the base portion and the tip portion. The method further includes detaching the first nozzle for dispersing the first coolant from the housing affixed to a vessel and attaching a second nozzle for dispersing a second coolant to the housing affixed to the vessel. The second nozzle has a tip portion that defines a second plurality of orifices for dispersing the second coolant in two or more directions, a base portion that is adapted for coupling to the housing, and a shaft portion that extends between the base portion and the tip portion.

BRIEF DESCRIPTION OF THE DRAWINGS

The invention is best understood from the following detailed description when read in connection with the accompanying drawings, with like elements having the same reference numerals. When a plurality of similar elements are present, a single reference numeral may be assigned to the plurality of similar elements with a small letter designation referring to specific elements. When referring to the elements collectively or to a non-specific one or more of the elements, the small letter designation may be dropped. In accordance with common practice, the various features of the drawings are not drawn to scale unless otherwise indicated. On the contrary, the dimensions of the various features may be expanded or reduced for clarity. Included in the drawings are the following figures.

DETAILED DESCRIPTION OF EMBODIMENTS OF THE INVENTION

Aspects of the present invention are directed to dual coolant systems, methods, and apparatuses. In an embodiment of the invention, a nozzle assembly is employed to enable an operator to switch between the delivery of a first coolant (e.g., liquid carbon dioxide or a cryogen, such as liquid nitrogen) and a second coolant (e.g., a cryogen, such as liquid nitrogen, or liquid carbon dioxide) to a vessel in an expeditious and safe manner.

Figure 1:
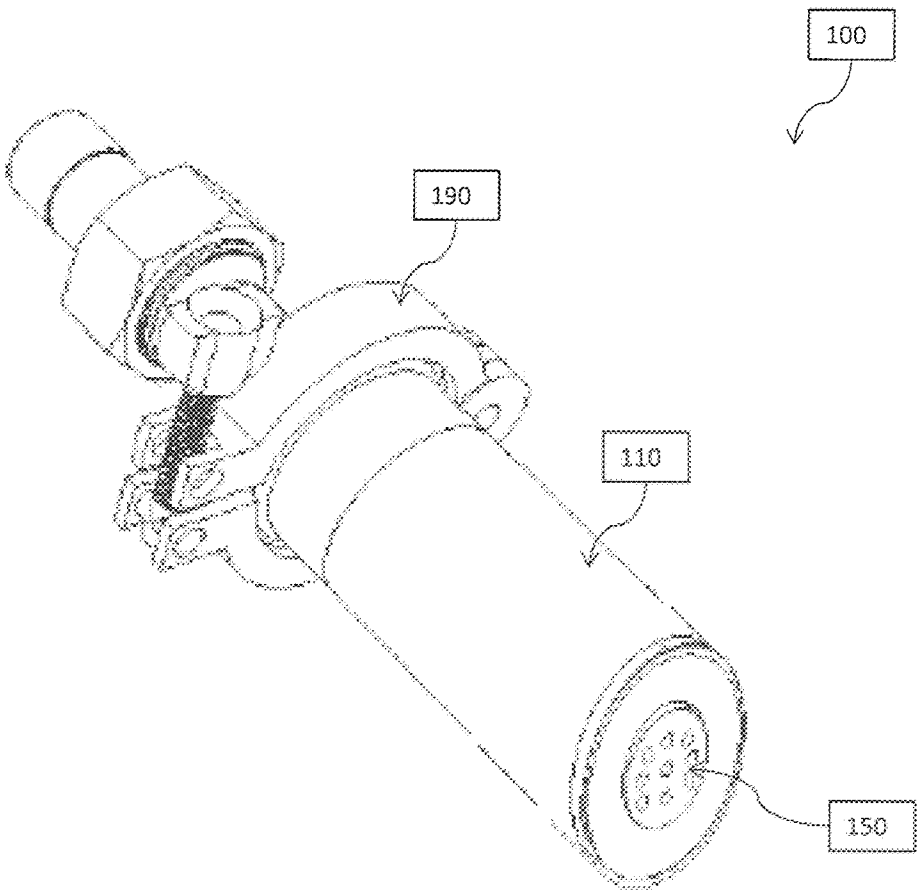
FIG. 1 is a perspective view of an embodiment of a nozzle assembly in accordance with aspects of the present invention.
Figure 2:
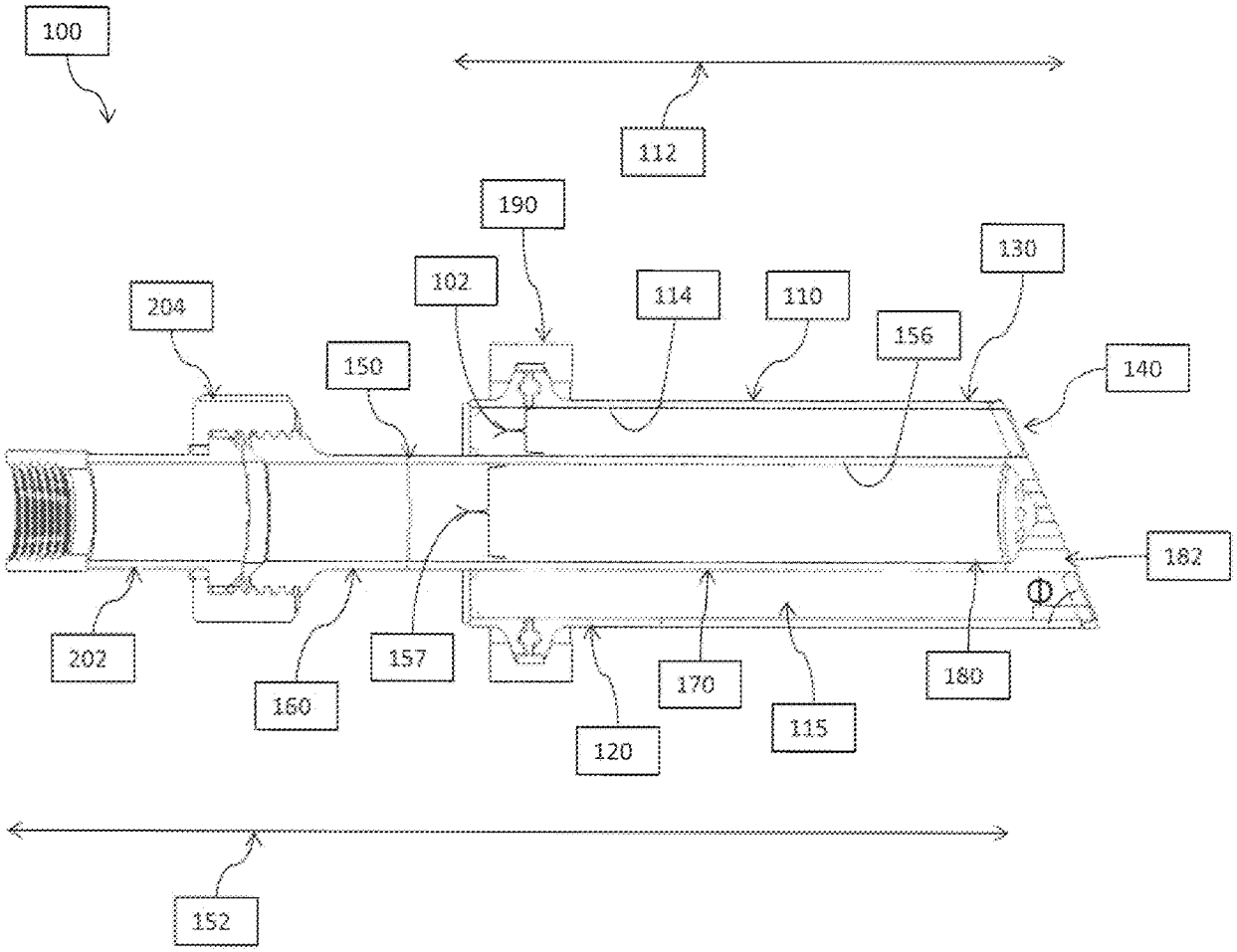
FIG. 2 is a cross-sectional view of the nozzle assembly of FIG. 1.
Figure 3:
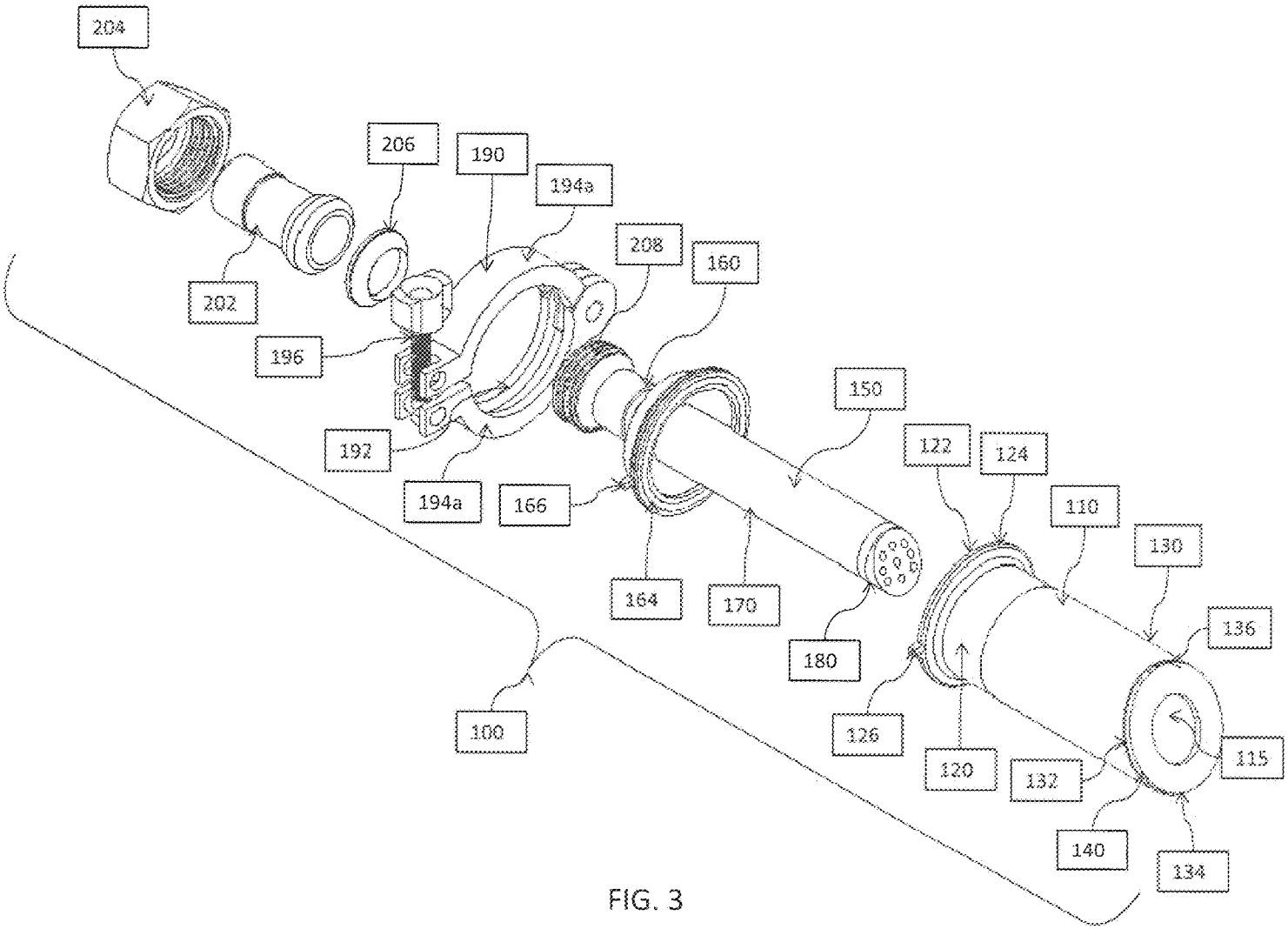
FIG. 3 is an exploded view of the nozzle assembly of FIG. 1.
Figure 4:
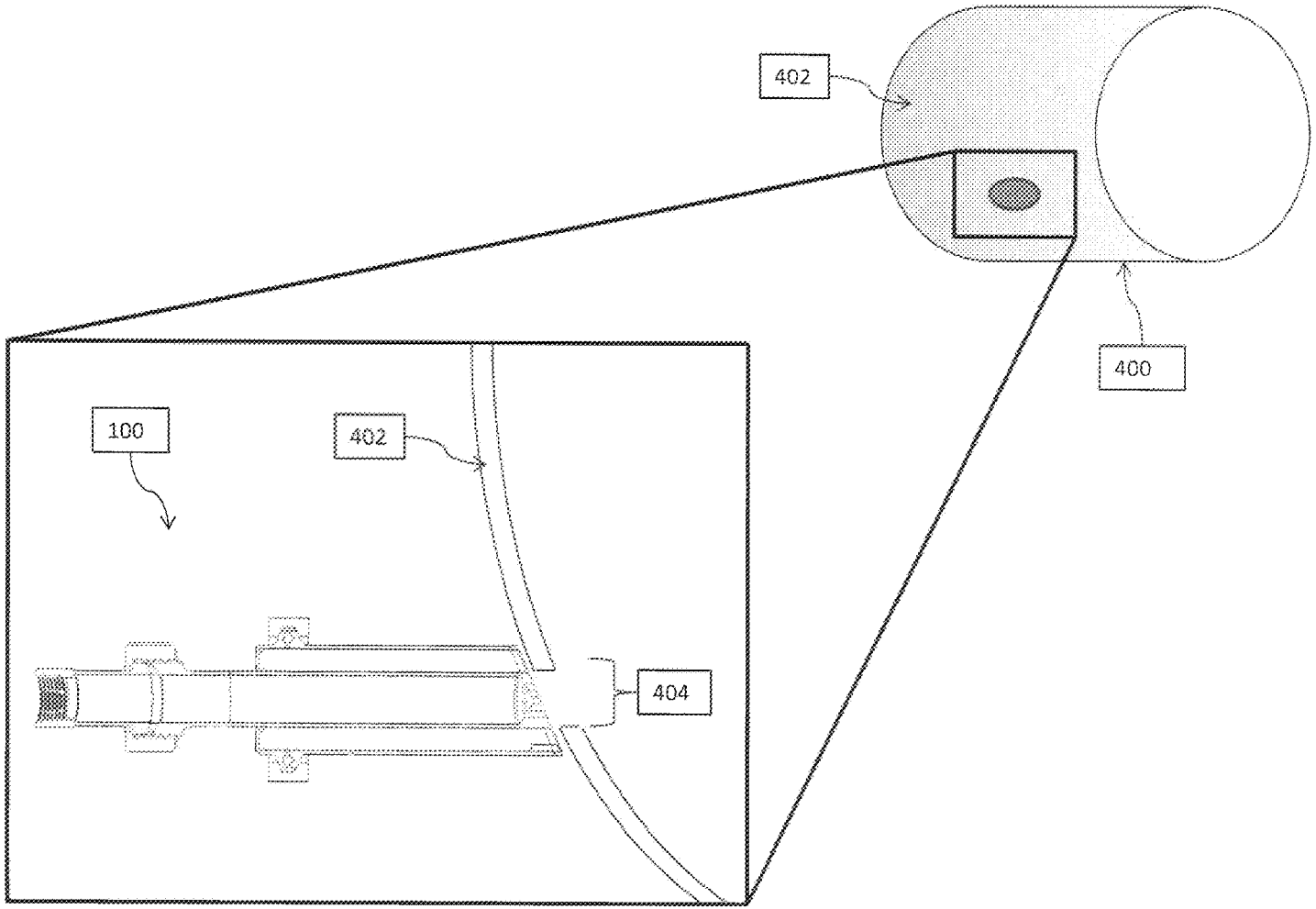
FIG. 4 is an enlarged view of the nozzle assembly of FIG. 1 affixed to a wall of a coolant vessel.
Figures 5A, 5B:
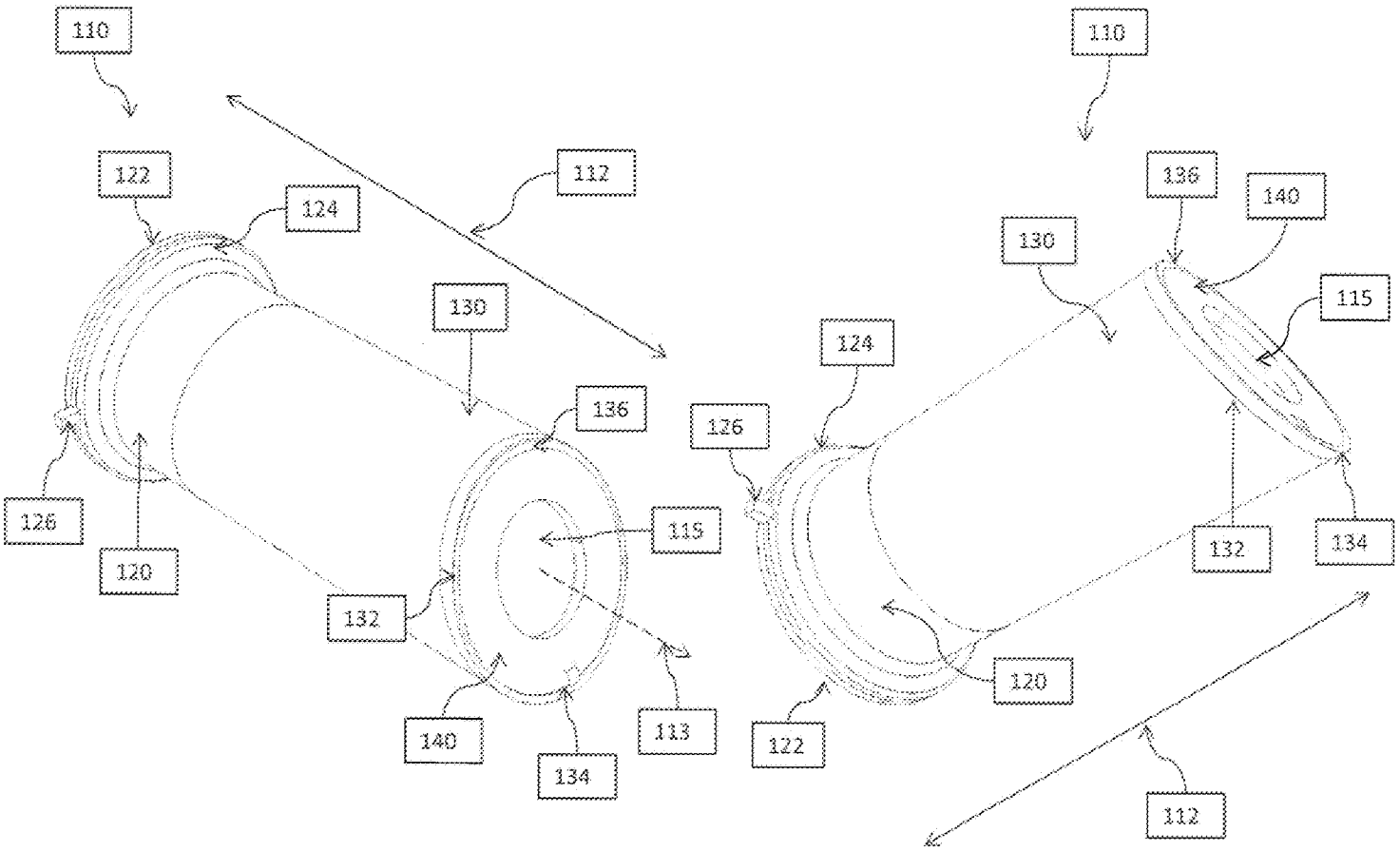
FIGS. 5A and 5B are perspective views of the housing of the nozzle assembly of FIG. 1.
Figure 5D:
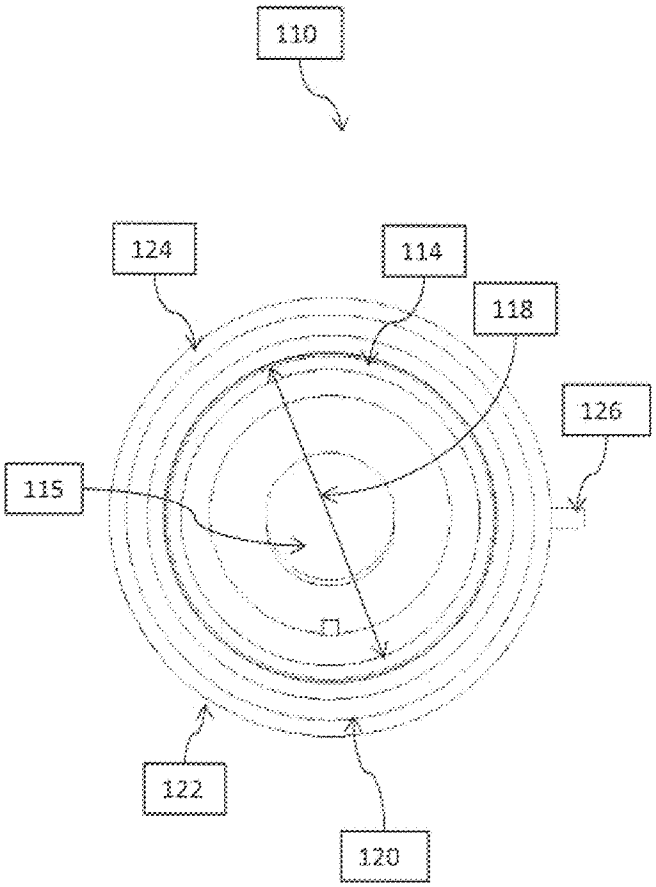
FIGS. 5C and 5D are a front and back view, respectively, of the housing of FIGS. 5A and 5B.
Figure 5C:
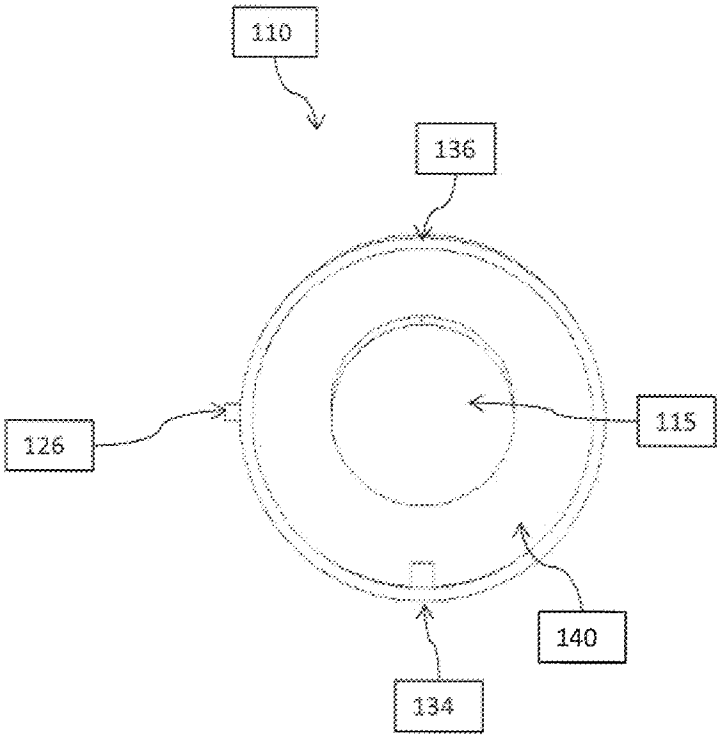

FIGS. 1-3 illustrate a non-limiting embodiment of a nozzle assembly 100 in accordance with aspects of the present invention and FIG. 4 illustrates a non-limiting example of a vessel 400 with which the nozzle assembly 100 may be used. As a general overview, the nozzle assembly 100 includes a housing 110 and the nozzle 150. The nozzle assembly 100 is configured to be affixed to a wall 402 of a vessel 400. Preferably, the vessel 400 is a coolant vessel having at least one wall 402 that is adapted to withstand the low temperatures and quick temperature changes associated with vaporizing coolants. Referring to FIG. 4, the nozzle assembly 100 may be affixed over an aperture 404 in the wall 402 of the vessel 400 (further described below) for dispersing a coolant into the vessel 400.

Referring to FIGS. 5A-5D, the housing 110 has a proximal end portion 130 and a distal end portion 120 spaced from the proximal end portion 130 along a length 112 of the housing 110. Although the housing 110 is illustrated as having a longitudinal axis 113 and a cylindrical shape in FIGS. 5A-5D, the housing 110 may have a shape that is non-cylindrical, such as a rectangular, square, pyramidal, or other geometric shape. In one embodiment, the shape of the housing is non-geometric.

The housing 110 defines a passageway 115 extending along the length 112 of the housing 110 from the proximal end portion 130 to the distal end portion 120. In one embodiment, the passageway 115 extends from a distal end 122 of the housing 110 to a proximal end 132 of the housing 110. The passageway 115 is delineated by an inner surface 114 of the housing 110. The passageway 115 may have a cross-sectional area 118 that varies along the length 112 of the housing 110, such that the passageway 115 may become more narrow or more broad along the length 112 of the housing 110. Additionally or alternatively, the inner surface 114 of the housing 110 may have one or more curved portions and/or straight portions, such that passageway 115 may be a geometric or non-geometric shape.

The proximal end portion 130 may have a proximal end 132 that includes a leading section 134. The leading section 134 of the proximal end 132 is configured to protrude further than a lagging section 136 of the proximal end 132, e.g., such that the length 112 of the housing 110 is greater between the distal end 122 and leading section 134 than between the distal end 122 and lagging section 136. The proximal end 132 may form an angle Φ (FIG. 2) that is acute with respect to the length 112 of the housing 110 at the leading section 134 of the proximal end 132.

The proximal end portion 130 and/or proximal end 132 of the housing may have an end plate 140 affixed thereto. The end plate 140 of the housing 110 extends toward the nozzle 150 and, in one embodiment, extends to the nozzle 150. For example, the end plate 140 of the housing 110 may extend to fit around nozzle 150 while leaving a space suitable to prevent rapid cooling of the end plate 140, thereby preventing undesired freezing of the food substance to the end plate.

The distal end portion 120 of the housing 110 may have a distal end 122 that is adapted for coupling, directly or indirectly, to the nozzle 150. For example, the distal end portion 120 may include a flange 124 for coupling or securing the housing 110 to another component of the nozzle assembly 100 (e.g., using a reusable clamp 190) to restrict axial displacement of the housing 110 relative to the other component(s) of the nozzle assembly 100 along longitudinal axis 113 of the housing 110.

The distal end portion 120 of the housing 110 may also have a securing element 126 that may be utilized to secure the housing 110 to another component of the nozzle assembly 100 such that it does not axially rotate. For example, the securing element 126 may be captured and/or surrounded by an indent, slot, aperture, groove, etc. to inhibit the housing 110 from axial rotation relative to the other component of the nozzle assembly 100. Additionally or alternatively, a groove and/or indent may be used in conjunction with or as a replacement for flange 124 and/or securing element 126.

The housing 110 is configured for attachment to a wall 402 of a vessel 400. As illustrated in FIG. 4, the proximal end 132 and/or the proximal end portion 130 of the housing 110 is affixed directly over the aperture 404 of the wall 402 of the vessel 400. Alternatively, housing 110 may be affixed to the wall 402 of the vessel 400 by way of coupling or attaching a portion of the housing 110 other than proximal end portion 130 to the wall 402 of the vessel 400. The attachment of the housing 110 to the wall 402 of the vessel 400 may be, e.g., by mechanical means, such as welding, riveting, threading, nailing, wedging, etc., or by non-mechanical means, such as adhesives or the like. In one embodiment, the end plate 140 of the housing 110 is welded to wall 402 of the vessel 400 such that the passageway 115 of the housing 110 is in communication with the interior of the vessel 400. For example, end plate 140 of the housing 110 may be attached to an area of the wall 402 of the vessel 400 around aperture 404. Preferably, the housing 110 is affixed to the wall 402 of the vessel 400 over the aperture 404 of wall 402.

Figures 6A, 6B:
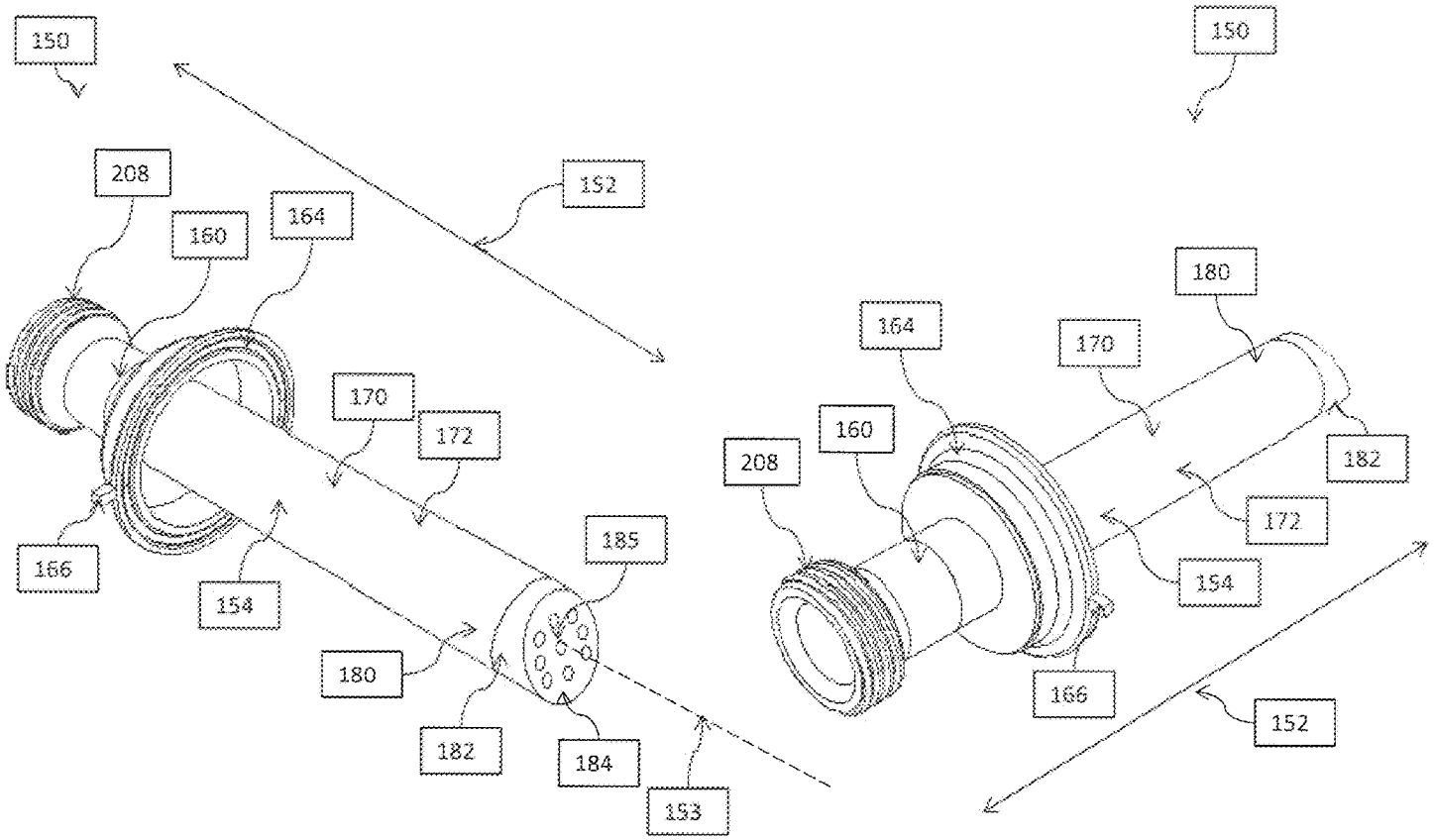
FIGS. 6A and 6B are perspective view of the nozzle of the nozzle assembly of FIG. 1.
Figure 6C:
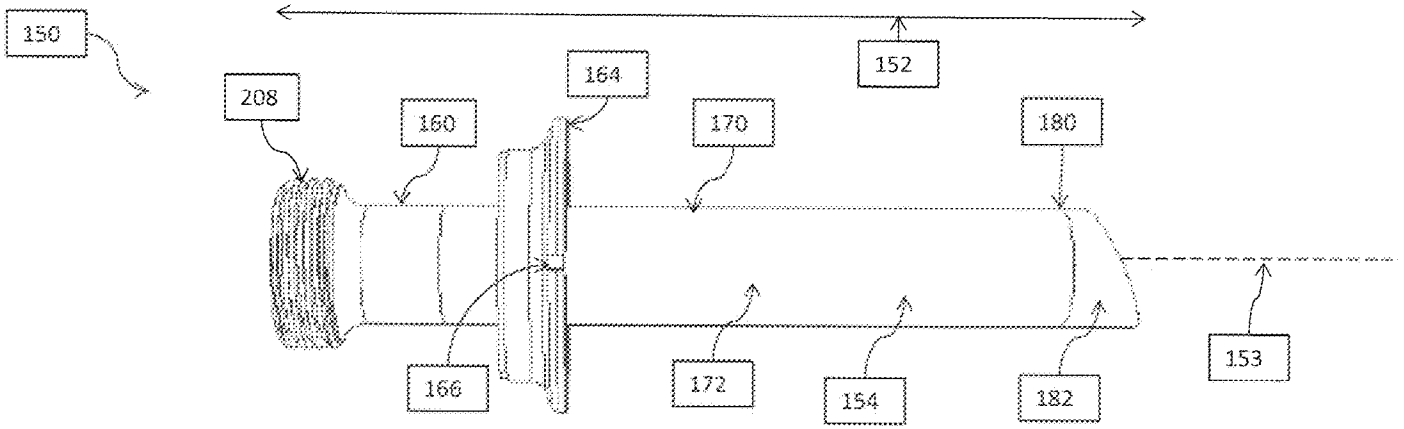
FIG. 6C is side view of the nozzle of FIGS. 6A and 6B.
Figure 6E:
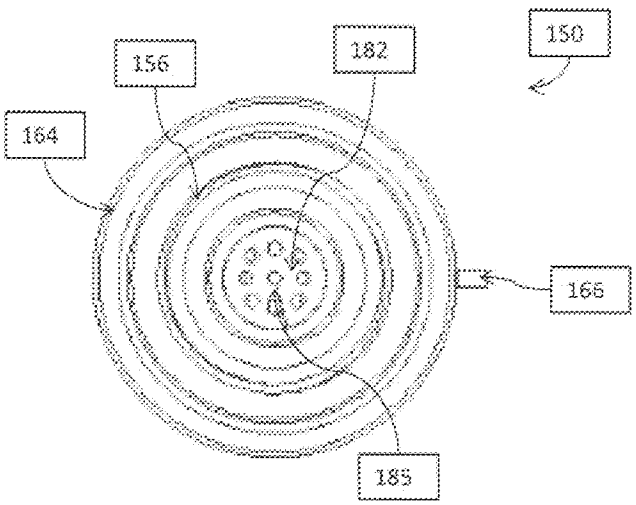
FIGS. 6D and 6E are a front and back view, respectively, of the nozzle of FIGS. 6A-6C.

Referring to FIGS. 6A-6E, the nozzle 150 includes a base portion 160, a shaft portion 170, and a tip portion 180. As illustrated in FIG. 6A, the nozzle 150 has a longitudinal axis 153 and an outer surface 154 extending along a length 152 of the nozzle 150. The nozzle 150 also has an inner surface 156 that defines a hollow channel 157 for delivering coolant that extends along the longitudinal axis 153 from the base portion 160 to a tip portion 180 of the nozzle 150.

The base portion 160 of the nozzle 150 is adapted for coupling to the housing 110. The base portion 160 may have a flange 164 and/or securing element 166 configured for coupling the base portion 160 of the nozzle 150 to the distal end portion 120 of the housing 110. The base portion 160 may also be adapted for coupling to a hose and/or channel for receiving coolant from a coolant source. As illustrated in FIG. 3, base portion 160 of the nozzle 150 may be connected to a hose attachment 202 by a threaded knob 204 and threads 208 disposed on the base portion 160. A washer 206 may be positioned adjacent to the hose attachment 202, such that threading threaded knob 204 onto threads 208 of the base portion 160 creates a seal between the hose attachment 202 and the washer 206 and between the washer 206 and the base portion 160 of the nozzle 150. One of ordinary skill in the art would recognize based on the description herein that other methods and manners for attaching the base portion of the nozzle to a hose and/or a coolant source may be readily used without deviating from the spirit and scope of the invention.

The shaft portion 170 has an outer surface 172 that extends from the base portion 160, e.g., along longitudinal axis 153 of the nozzle 150. Although the shaft portion 172 is illustrated in FIGS. 6A-6E as cylindrical, in another embodiment the shaft portion 170 has a non-cylindrical shape, such as a rectangular, square, pyramidal, and/or other geometric or non-geometric shape.

The tip portion 180 is coupled the shaft portion 170 of the nozzle 150. The tip portion 180 includes a plurality of orifices 185 for dispersing coolant. In one embodiment, the tip portion 180 includes an end plate 182 that defines the plurality of orifices 185. The plurality of orifices 185 extend through the end plate 182 of the nozzle 150, e.g., from the an outer surface 184 of the end plate 182 to the hollow channel 157 of the nozzle 150, in two or more directions for dispersing the coolant in two or more directions. In one embodiment, the plurality of orifices 185 disperses coolant in three or more directions with one of the directions of dispersion aligning and/or being parallel with the longitudinal axis 153 of the nozzle 150.

Figure 6D:
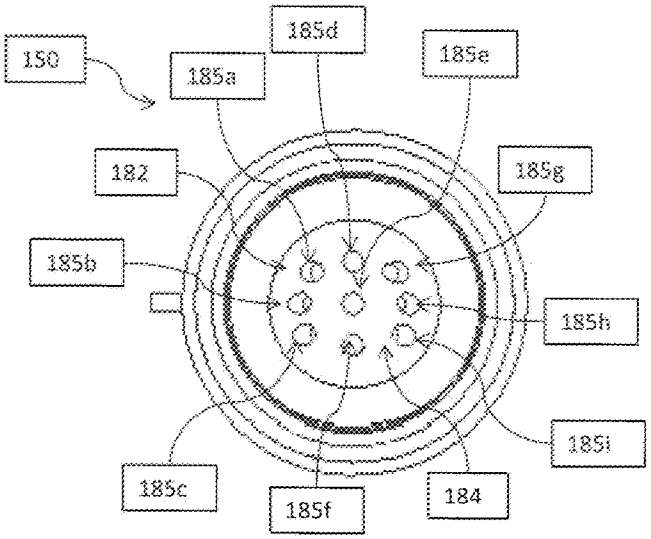
Figure 7:
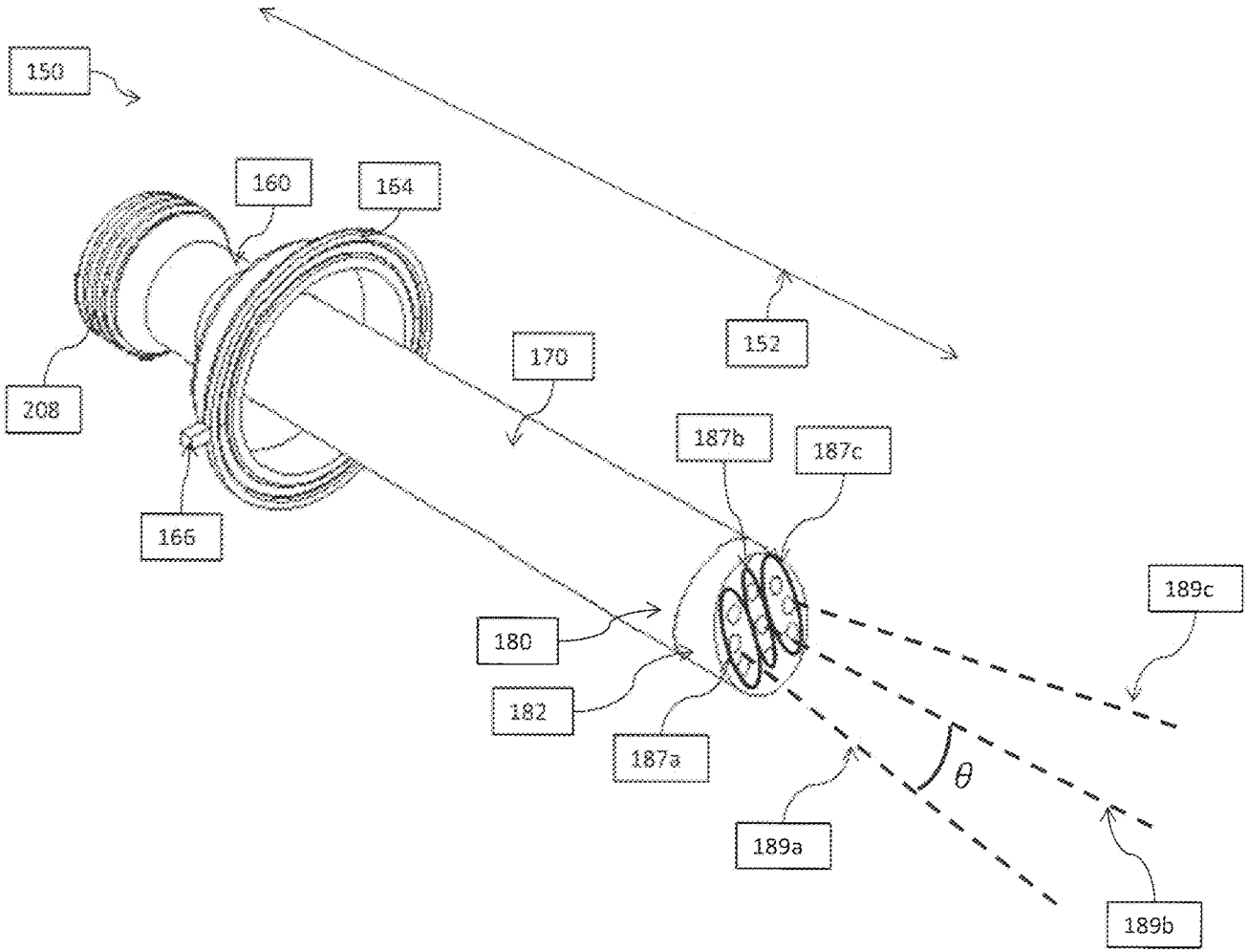
FIG. 7 is an illustration of the nozzle of FIGS. 6A-6E dispersing coolant in two or more directions.

The plurality of orifices 185 may be configured in two or more rows 187 of orifices 185. Each row 187 of orifices 185 may be configured to disperse coolant into the vessel 400 in a different direction. A row 187 of orifices 185 is any number of adjacent orifices 185 that disperse coolant in same direction. For example, as illustrated in FIGS. 6D and 7, orifices 185*a*, 185*b*, and 185*c* may be configured to form a first row 187*a* of orifices 185, orifices 185*d*, 185*e*, and 185*f* may be configured to form a second row 187*b* of orifices 185, and orifices 185*g*, 185*h*, and 185*i* may be configured to form a third row 187*c* of orifices 185. The first row 187*a* of orifices 185 may disperses coolant in a first direction 189*a*, the second row 187*b* of orifices 185 may disperses coolant in a second direction 189*b*, and the third row 187*c* of orifices may disperses coolant in a third direction 189*c*. In one embodiment, the angle θ between the first direction 189*a* and the second direction 189*b* and/or the second direction 189*b* and the third direction 189*c* is 15° or more.

Referring to FIG. 4, the nozzle assembly 100 includes a reusable clamp 190 configured for coupling the nozzle 150 to the housing 110. The reusable clamp 190 may have a groove 192 adapted for receiving the flange 124 of the housing 110 and/or the flange 164 of the nozzle 150. Preferably, the groove 192 of the reusable clamp 190 fits the flange 124 of the housing 110 and/or the flange 164 of the nozzle 150, such that the nozzle 150 is inhibited from axial displacement along longitudinal axis 153 and/or 113 with respect to the housing 110. The reusable clamp 190 may also have an indent adapted for receiving the securing element 126 of the housing 110 and/or the securing element 166 of the nozzle 150 for inhibiting axial displacement of the nozzle 150 along longitudinal axis 153 and/or axial rotation of the nozzle 150 with respect to the housing 110. In one embodiment, when the nozzle 150 is coupled to the housing 110, the tip portion 180 of the nozzle 150 is prevented from contacting the end plate 140 of the housing 110, thereby preventing direct thermal conduction between the tip portion 180 of the nozzle 150 and the end plate 140 of the housing 110 and the buildup of food composition on the end plate 140 of the housing 110. Additionally and/or alternatively, the reusable clamp 190 may have one or more protrusions in conjunction with or as a replacement to groove 192 that corresponds to grooves and/or indents disposed on the nozzle 150 and/or the housing 110.

When the nozzle 150 is coupled to the housing 110, the outer surface 154 extending along the length 152 of the nozzle 150 is spaced from the inner surface 114 of the housing 110 to create a gap 102 therebetween. The gap 102 may extend from the base portion 160 along the outer surface 172 of the shaft portion 170 to end plate 182 of the tip portion 180. In one embodiment, the gap 102 extends from the proximal end 132 of the housing 110 to the distal end 122 of the housing 110. A thickness 104 of the gap 102 (e.g., a distance between the inner surface 114 of the housing 110 and the outer surface 154 and/or 172 of the nozzle 150) may vary along the length 112 of the housing 110 when the inner surface 114 of the housing 110 and/or the outer surface 154 and/or 172 of the nozzle 150 varies along the length 112 of the housing 110.

The nozzle assembly 100 may be configured such that, when the nozzle 150 is coupled to the housing 110, the tip portion 180 is disposed at least partially within the proximal end portion 130 of the housing 110 and the shaft portion 170 is disposed at least partially within the distal end portion 120 of the housing 110. Additionally or alternatively, the end plate 182 of the nozzle 150 may be configured to align with the wall 402 of the vessel 400 when the nozzle 150 is coupled to the housing 110 and the housing 110 is affixed to the wall 402 of the vessel 400. In one embodiment, the end plate 182 of the nozzle 150 aligns with the end plate 140 of the housing 110 when nozzle 150 is coupled to the housing 110 and the housing 110 is affixed to the wall 402 of the vessel 400. In another embodiment, the nozzle assembly 100 is configured to be affixed to the wall 402 of the vessel 400 below the height of the food composition contained in the vessel 400, such that the tip portion 180 (e.g., the end plate 182 and/or plurality of the orifices 185) are exposed directly to the food composition.

Figure 8:
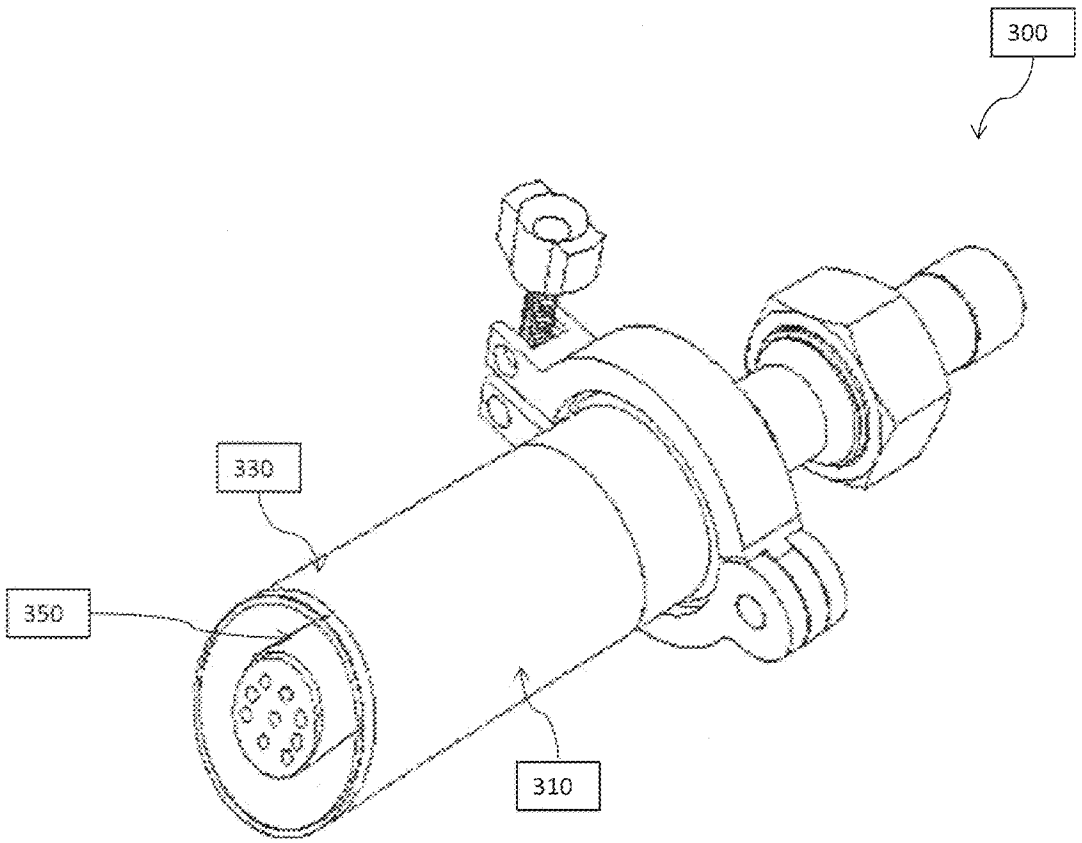
FIG. 8 is perspective view of another embodiment of a nozzle assembly according to aspects of the present invention.

FIG. 8 illustrates another non-limiting embodiment of a nozzle assembly 300 in accordance with aspects of the present invention. As a general overview, the nozzle assembly 300 includes a housing 310 and a nozzle 350. The nozzle assembly 300 is similar to the nozzle assembly 100, except that the nozzle assembly 300 does not include an end plate attached to the proximal end portion 330 of the housing 310.

Figure 9:
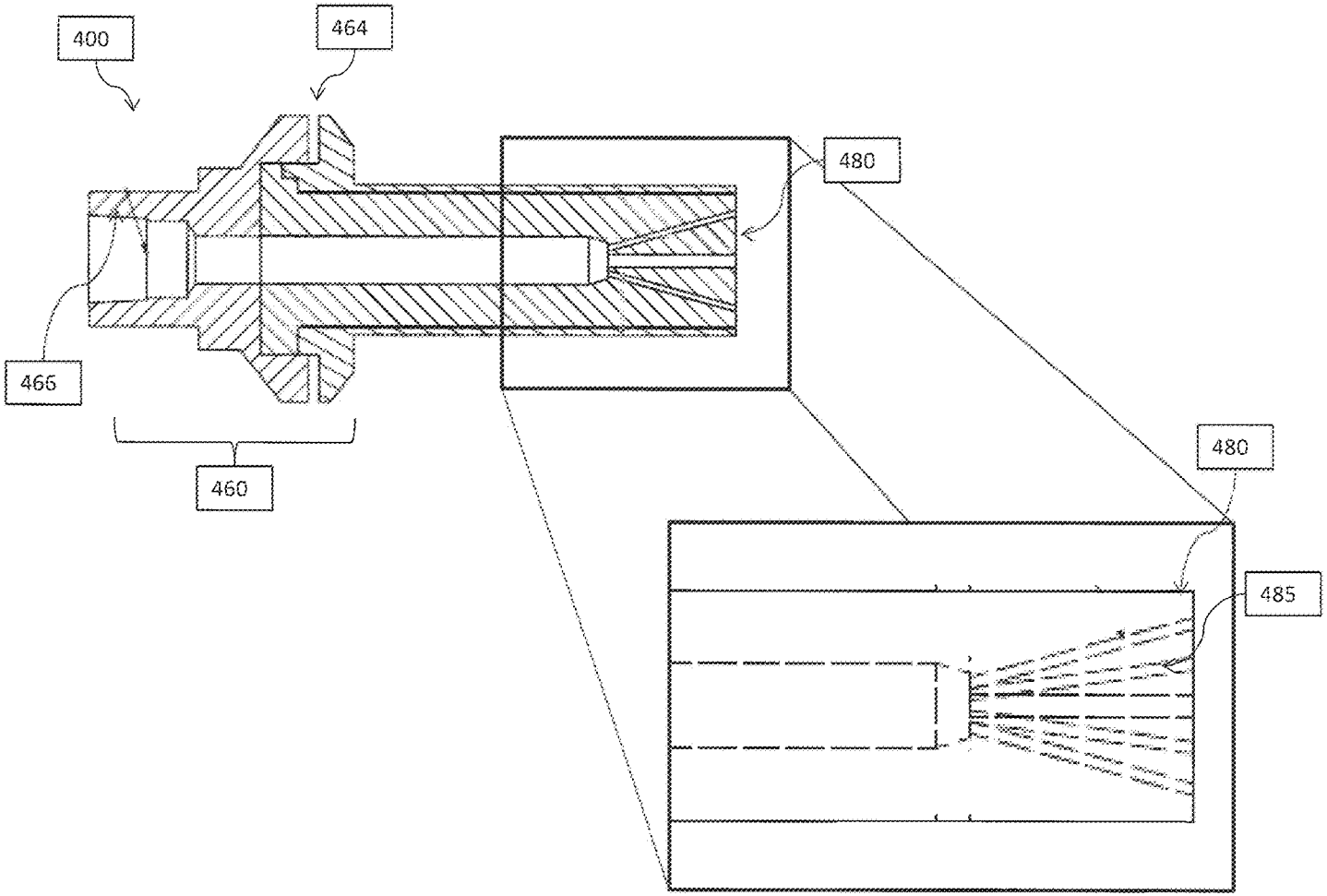
FIG. 9 is a cross-sectional view and an exploded view of an additional embodiment of a nozzle assembly in accordance with aspects of the invention.

FIG. 9 illustrates an additional non-limiting embodiment of a nozzle assembly 900 according to aspects of the present invention. The nozzle assembly 400 is similar to the nozzle assembly 100, except that the nozzle assembly 400 includes an end plate having a different configuration of orifices 485 for tip portion 480 and a different base portion 460.

Figure 10:
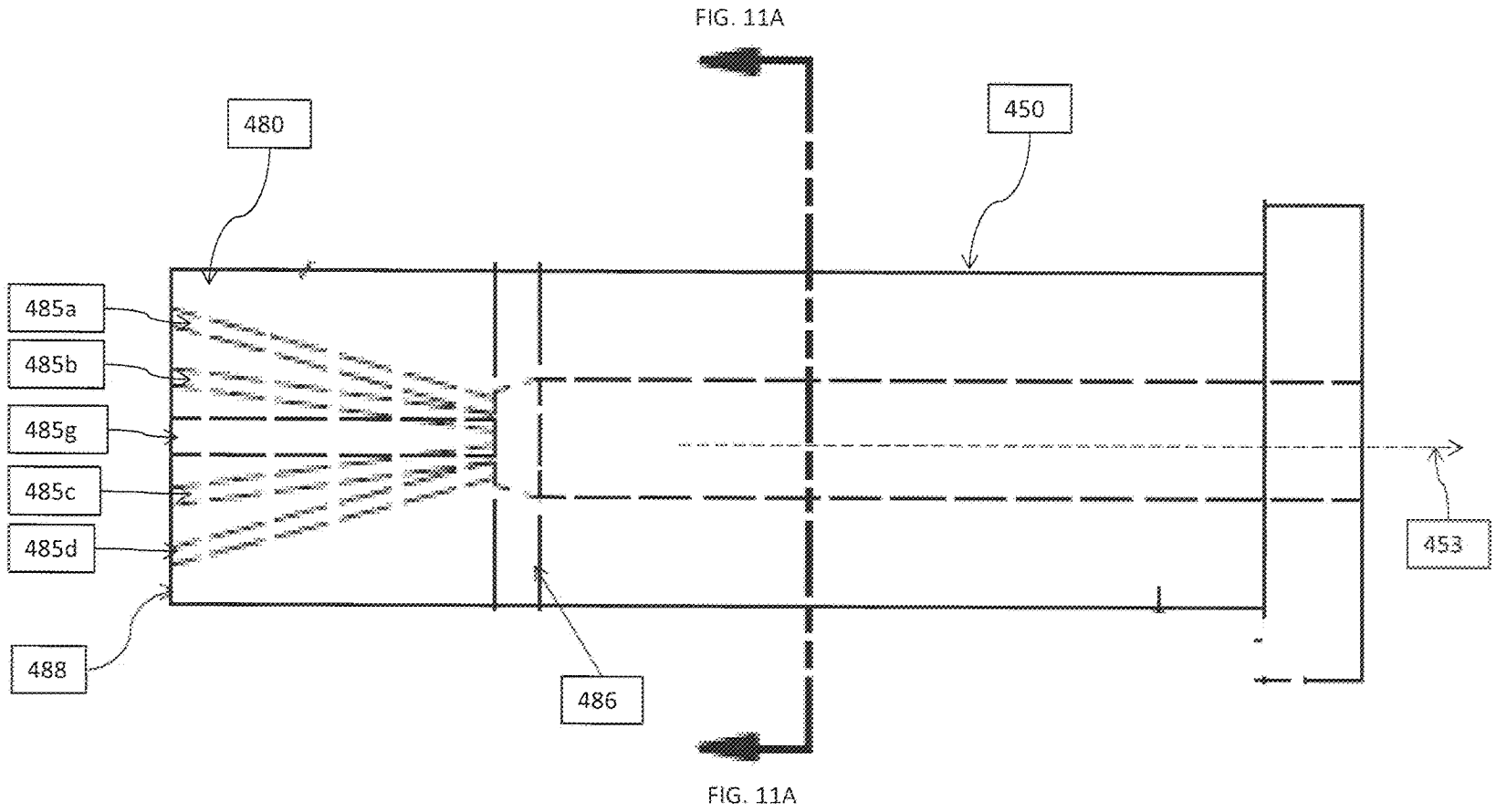
FIG. 10 is a cross-sectional view of the nozzle of FIG. 9, which semi-transparently illustrates a plurality of orifices.
Figure 11B:
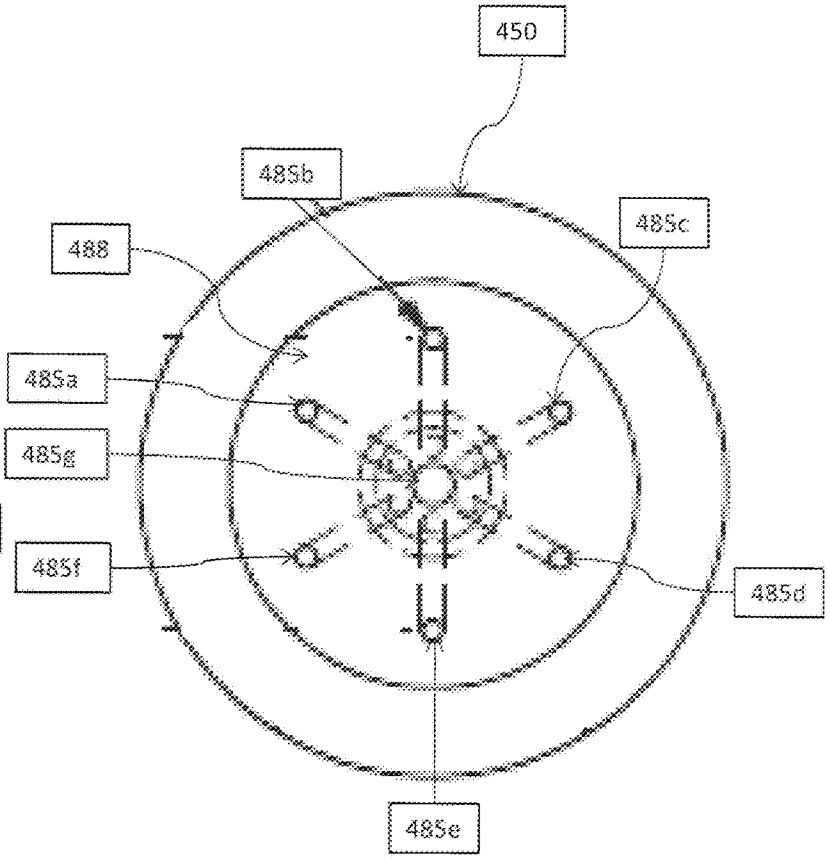
FIG. 11B is a front view of the nozzle of FIG. 9, which semi-transparently illustrates the plurality of orifices extending through an end plate.
Figure 11A:
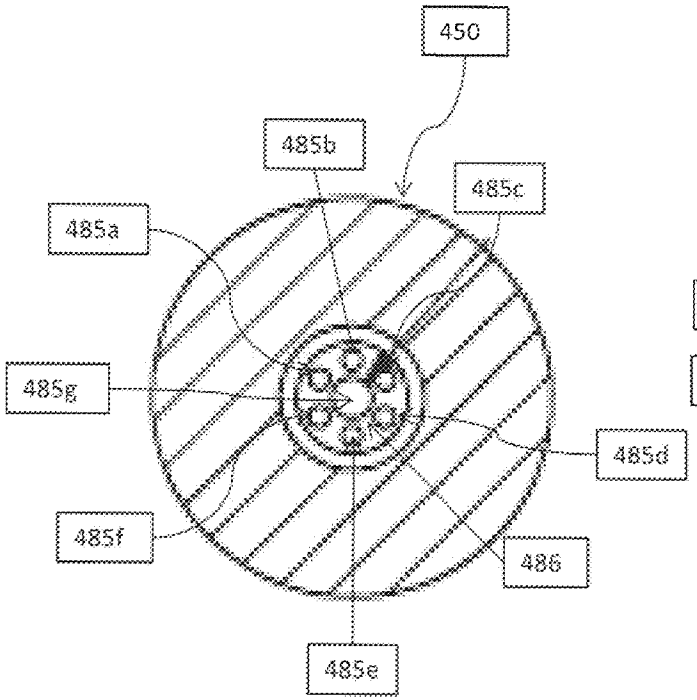
FIG. 11A is a cross-sectional view of the nozzle of FIG. 10.

As illustrated in FIGS. 10 and 11B, the plurality of orifices 485 includes a central orifice 485*g* and auxiliary orifices 485*a*-485*f*. The central orifice 485*g* extends through the tip portion 480 in a direction that may be parallel or coaxial with the longitudinal axis 453 of nozzle 450. The central orifice 485*g* may have a diameter that is larger than the diameter of one or more of the auxiliary orifices 485*a*-485*f*. In one embodiment, the central orifice 485*g* has a diameter that is about twice as large as the average of the diameters for the auxiliary orifices 485*a*-485*f*.

The auxiliary orifices 485*a*-485*f* may extend through the tip portion 480 in both an axial and radial direction with respect to nozzle 450. For example, the auxiliary orifices 485*a*-485*f* may extend in a direction radially outward from the central orifice 485*g* as the auxiliary orifices 485*a*-485*f* extend through from an inner side 486 of tip portion 480 to an outer side 488 of tip portion 480.

The base portion 460 of the nozzle 450 has a flange 464 configured for coupling the base portion 460 of the nozzle 450 to the housing (e.g., housing 110). The base portion 460 is also adapted for coupling to a hose and/or channel for receiving coolant from a coolant source. Although the embodiment illustrated in FIG. 9 includes a receptacle 466 for receiving a hose that has a smooth surface, receptacle 466 may include threads, grooves, protrusions, and the like to facilitate coupling of a hose to the base portion 460. One of ordinary skill in the art would recognize based on the description herein that other methods and manners for attaching the base portion of the nozzle to a hose and/or a coolant source may be readily used without deviating from the spirit and scope of the invention.

Figure 12B:
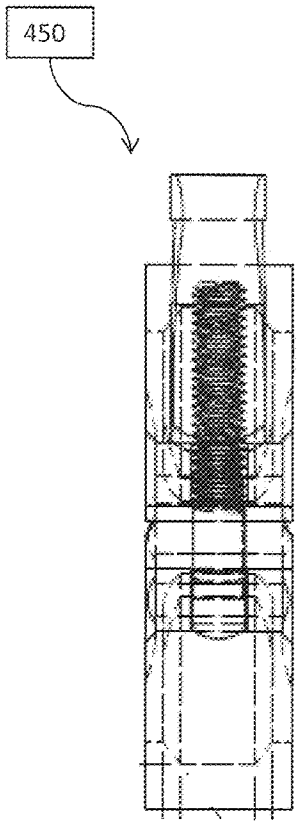
FIGS. 12A and 12B are front and side semi-transparent views of an embodiment of a clamp according to aspects of the present invention.
Figure 12A:
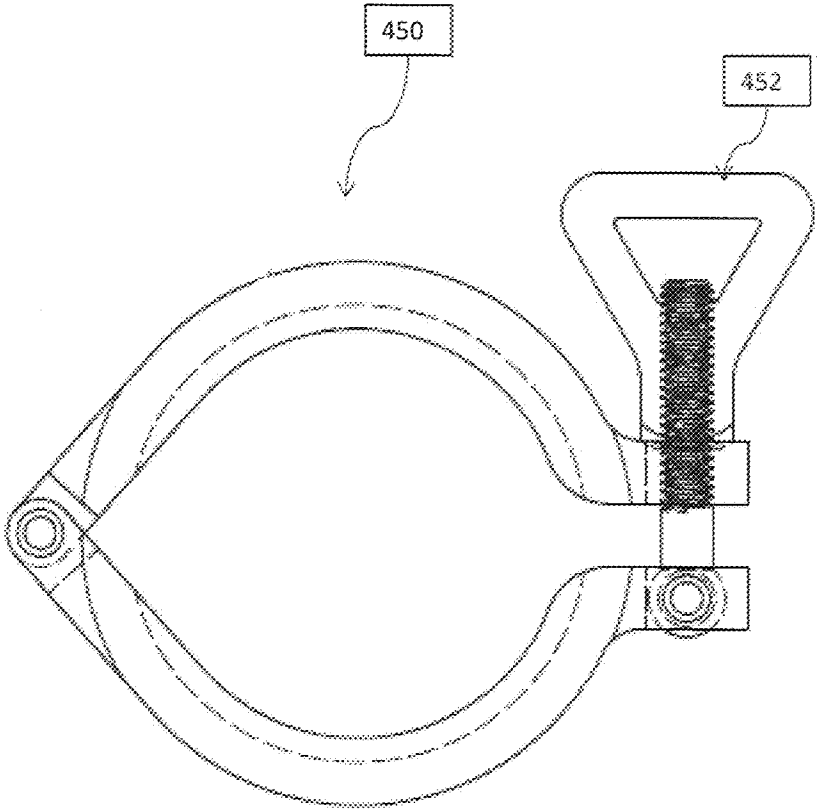

FIGS. 12A and 12B illustrate another non-limiting embodiment of a clamp 490 in accordance with aspects of the invention. Clamp 490 is similar to clamp 190, but is adapted for coupling to nozzle 400. For example, clamp 490 may be dimensioned to fit the base portion 460 of nozzle 450. In addition, clamp 490 includes a bolt 452 for tightening clamp 450 that is adapted to fit a user's hand.

Figure 13:
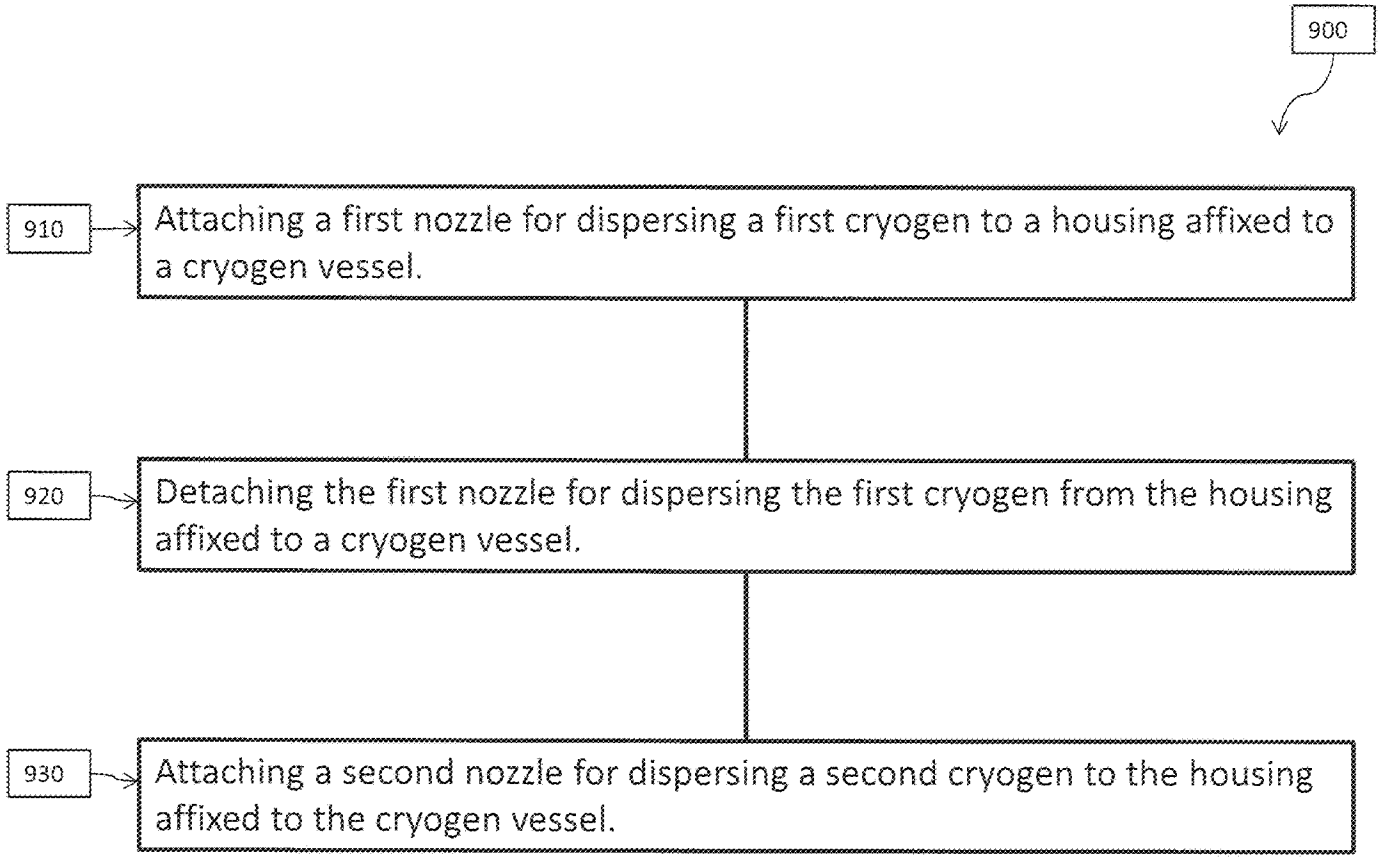
FIG. 13 is a method for switching from delivery of a first coolant to delivery of a second coolant for a coolant vessel in accordance with aspects of the present invention.

FIG. 13 depicts a non-limiting embodiment of a method 900 for switching from delivery of a first coolant to delivery of a second coolant for a coolant vessel in accordance with aspects of the present invention. Method 900 is described with reference to various features of the nozzle assembly 100 for the sole purpose of facilitating description thereof. Other suitable systems and apparatuses will be understood by one of ordinary skill in the art from the description provided herein.

In step 910, a first nozzle for dispersing a first coolant, e.g., liquid carbon dioxide, is attached to a housing that is affixed to a vessel 400, e.g., a coolant vessel. The first nozzle may be attached to the housing 110 using a reusable clamp 190 and/or another coupling element. For example, the first nozzle, or a portion thereof, may be positioned within the passageway 115 delineated by an inner surface 114 of the housing 110 and coupled to the housing 110 by engaging the reusable clamp 190 to a portion of the first nozzle and a portion of the housing 110. In one embodiment, a tip portion 180 and at least a section of the shaft portion 170 of first nozzle is positioned within the passageway 115 of the housing 110 prior to attaching the first nozzle to the housing 110. Preferably, the tip portion 180 is disposed within the passageway 115 at the proximal end portion 130 of the housing 110 approximate the aperture 404 of the wall 402 of the vessel 400. A gap 102 extending from a proximal end portion 130 to a distal end portion 120 of the housing 110 may be defined when the first nozzle is positioned within passageway 115 and/or coupled to the housing 110.

The reusable clamp 190 may have a first side 194*a* and a second side 194*b* adapted for positioning around the housing 110 and the first nozzle, e.g., the distal end portion 120 of the housing 110 and the base portion 160 of the first nozzle. The reusable clamp 190 may have a groove 192 and/or indent adapted for engaging the first nozzle and the housing 110 by enclosing and/or surrounding a flange 164 of the first nozzle and a flange 124 of the housing 110. In one embodiment, as depicted in FIG. 2, attaching the first nozzle to the housing 110 positions the flange 164 of the first nozzle adjacent the flange 124 of the housing 110. The reusable clamp 190 may be tightened around the flange 164 of the first nozzle and the flange 124 of the housing 110 by, e.g., increasing the pressure between the sides 194*a* and 194*b* of the reusable clamp 190 using threaded screw 196.

The first nozzle may also be attached to a first source using a hose attachment 202, which is adapted for attachment to a source hose. The hose attachment 202 may buttress a washer 206 to form a seal allowing fluid communication from the source hose to the first nozzle. The hose attachment 202 and the washer 206 may be coupled and secured to the first nozzle, e.g., by way of a threaded knob 204 having threads corresponding to threads on the base portion 160 of the first nozzle.

In step 920, the first nozzle for dispersing the first coolant is detached from the housing 110 affixed to a vessel 400. The first nozzle may be detached by disengaging and removing the reusable clamp 190 and withdrawing the first nozzle from the housing 110. The reusable clamp 190 may subsequently be removed from the first nozzle. The first nozzle may be detached from a first coolant source hose prior to or after removing the first nozzle from the housing 110.

In step 930, a second nozzle for dispersing a second coolant, e.g., liquid nitrogen, is attached to the housing 110 affixed to the vessel 400. The second nozzle may be attached to the housing 110 in a manner similar to the attachment of the first nozzle to the housing 110. For example, the second nozzle may be attached to the housing 110 by engaging a reusable clamp 190 to the second nozzle and the housing 110, or respective portions thereof. The second nozzle may be attached to a second coolant source hose to disperse a second coolant. Attachment of the second nozzle to the second coolant source hose may be similar to the attachment of the first nozzle to the first coolant source hose. In one embodiment, the second coolant source hose is the same hose as the first coolant source hose, but the source hose is attached to a different coolant source. The first coolant source may be liquid nitrogen or liquid carbon dioxide, while the second coolant source may be the other of liquid nitrogen or liquid carbon dioxide.

The first and second nozzles have tip portions defining a first and a second plurality of orifices, respectively, for dispersing a first and a second coolant in two or more directions. The first plurality of orifices for the first nozzle may differ from the second plurality of orifice for the second nozzle, e.g., by the number and/or size of the orifices. Additionally or alternatively, the first nozzle may disperse a first coolant in directions that differ from the second nozzle's dispersion of the second coolant. By employing a first and second nozzle, method 900 enables effective and efficient dispersion of both the first coolant and the second coolant. For example, the nozzle configured to disperse liquid nitrogen may have a greater number of orifices, but a reduced size for each orifice as compared to the plurality of offices of the nozzle configured to disperse liquid carbon dioxide.

Although the invention is illustrated and described herein with reference to specific embodiments, the invention is not intended to be limited to the details shown. Rather, various modifications may be made in the details within the scope and range of equivalents of the claims and without departing from the invention.

What is claimed is:

1. A method for switching from delivery of a first coolant to delivery of a second coolant for a vessel, the method comprising the steps of:

attaching a first nozzle for dispersing a first coolant to a housing affixed to a vessel, the first nozzle having a tip portion defining a first plurality of orifices for dispersing a first coolant in two or more directions, a base portion adapted for coupling to the housing, and a shaft portion extending between the base portion and the tip portion;

detaching the first nozzle for dispersing the first coolant from the housing affixed to a vessel; and attaching a second nozzle for dispersing a second coolant to the housing affixed to the vessel, the second nozzle having a tip portion defining a second plurality of orifices for dispersing the second coolant in two or more directions, a base portion adapted for coupling to the housing, and a shaft portion extending between the base portion and the tip portion.

2. The method of claim 1, wherein the step of detaching the first nozzle from the housing comprises disengaging a reusable clamp that couples the base of the first nozzle to the housing affixed to the vessel.

3. The method of claim 1, wherein the step of attaching the second nozzle comprises engaging a reusable clamp.

4. The method of claim 1, further comprising detaching the first nozzle for dispersing the first coolant from a first coolant source hose.

5. The method of claim 1, further comprising attaching the second nozzle for dispersing the second coolant to a second coolant source hose.

6. The method of claim 1, wherein the first coolant is liquid carbon dioxide.

7. The method of claim 5, wherein the second coolant is liquid nitrogen.

8. The method of claim 1, wherein the inner surface of the housing and the outer surface of the first nozzle define a gap extending from a proximal end portion to a distal end portion of the housing when the first nozzle is coupled to the housing.

* * * * *